United States Patent [19]

Kappenhagen

[11] Patent Number: 4,735,291

[45] Date of Patent: Apr. 5, 1988

[54] HYDRAULIC JACK ASSEMBLY FOR A HYDRAULIC ELEVATOR

[75] Inventor: George A. Kappenhagen, Stroud Township, Monroe County, Pa.

[73] Assignee: Westinghouse Electric Corp., Pittsburgh, Pa.

[21] Appl. No.: 940,387

[22] Filed: Dec. 11, 1986

[51] Int. Cl.[4] ..... B66B 11/04

[52] U.S. Cl. ..... 187/17; 92/86

[58] Field of Search ..... 187/17, 67, 1 R; 92/86, 92/142; 254/93 R, 2 R; 277/2, 17, 19

[56] References Cited

U.S. PATENT DOCUMENTS 4,041,845 8/1977 Mean et al. ..... 92/85 A
4,128,831 12/1978 Rensch et al. ..... 92/86
4,361,209 11/1982 Kappenhagen et al. ..... 187/17

FOREIGN PATENT DOCUMENTS 121354 10/1978 Japan ..... 187/17

*Primary Examiner*—Joseph J. Rolla
*Assistant Examiner*—Kenneth Noland
*Attorney, Agent, or Firm*—D. R. Lackey

[57] ABSTRACT

A hydraulic jack assembly for a hydraulic elevator including a jack having a cylinder, cylinder head and plunger, and a footer for mounting the jack which includes a box beam having a bottom, side webs and lateral flanges. The cylinder extends through the bottom of the box beam and is fixed to the bottom and lateral flanges. End plates are fixed inwardly from the ends of the box beam to define an overflow oil reservoir which surrounds the jack below the cylinder head for collecting oil which may leak from the cylinder head.

8 Claims, 3 Drawing Sheets

HYDRAULIC JACK ASSEMBLY FOR A HYDRAULIC ELEVATOR

BACKGROUND OF THE INVENTION

1. Field of the Invention:

The invention relates in general to hydraulic elevators, and more specifically to a hydraulic jack assembly for a hydraulic elevator.

2. Description of the Prior Art:

A hydraulic elevator conventionally includes a pair of spaced footing channels fixed in a pit of the associated building, on opposite sides of a jack hole. The jack is lowered into the jack hole and supported by the pair of footing channels. A pair of buffers are mounted on metallic plates which are welded across the footing channels, near the ends of the channels. U.S. Pat. No. 4,041,845, which is assigned to the same assignee as the present application, illustrates such a prior art mounting arrangement.

Since the plunger of the jack must slide through a seal in the cylinder head, some oil must necessarily leak past the seal. As shown in the aforesaid patent, leakage oil is accommodated via a scavenger line which may return the leakage oil to the hydraulic power unit, and by an excess fluid gravity drain line which may drain leakage oil to a bucket in the pit.

SUMMARY OF THE INVENTION

Briefly, the present invention is a new and improved hydraulic jack assembly for a hydraulic elevator which enables the jack, mounting footer, and buffers to be pre-assembled. The footer, for adequate mechanical strength, requires the equivalent of two spaced channels, with the channel webs vertically oriented. The present invention consolidates the two spaced channels into a single elongated box beam having first and second ends. The single box beam facilitates pre-assembly with the hydraulic jack, and it is constructed to simultaneously provide a reservoir which surrounds the hydraulic cylinder and collects leakage oil from the cylinder head. The vertical webs of the box beam are strengthened by on-center web stiffeners which also function as lifting eyes for the completed assembly. The web stiffeners are disposed symmetrically about the hydraulic cylinder, and they are welded to webs and flanges of the box beam, and to the hydraulic cylinder. The box beam is supported adjacent to its first and second ends by a total of four vertically oriented bars, two at each end, which are welded to the webs of the box beam, to further strengthen the webs. Levelers are attached to the lower ends of the four support bars, and the levelers at the first and second ends of the box bars engage and are supported by first and second cross bars whose longitudinal axes are oriented perpendicular to the longitudinal axis of the box beam. The cross bars prevent movement or skidding of the assembly when the levelers are adjusted. The hydraulic jack assembly may be secured to the elevator pit, such as may be required by elevator earthquake codes, by bolting each end of the box beam to a separate cross bar member, and by fastening the ends of each cross bar member to the pit floor.

BRIEF DESCRIPTION OF THE DRAWINGS

The invention may be better understood, and further advantages and uses more readily apparent, when considered in view of the following detailed description of exemplary embodiments, taken with the accompanying drawings, in which.

DESCRIPTION OF PREFERRED EMBODIMENTS

Figure 1:
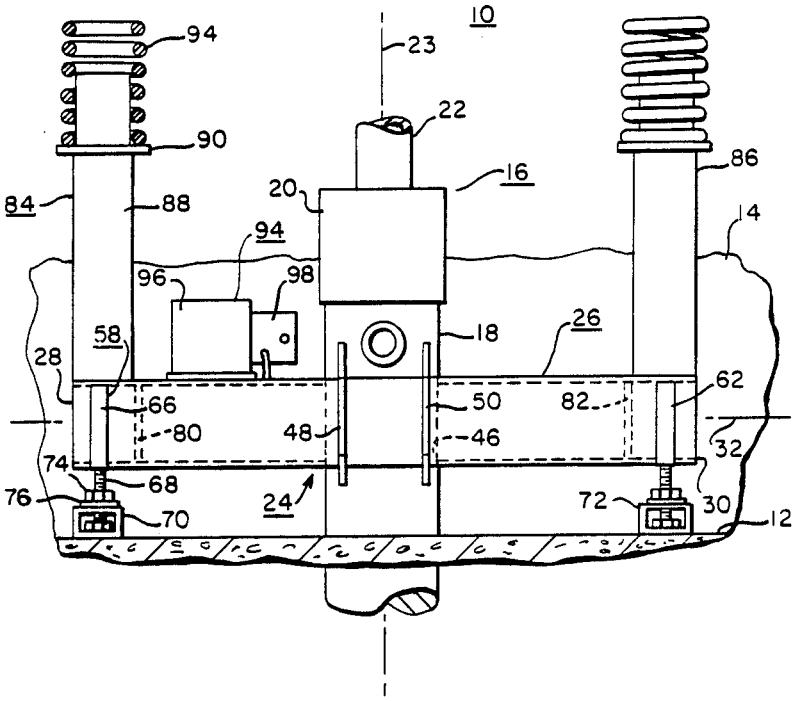
FIG. 1 is a side elevational view of a hydraulic jack assembly, including footers and buffers, constructed according to the teachings of the invention.
Figure 3:
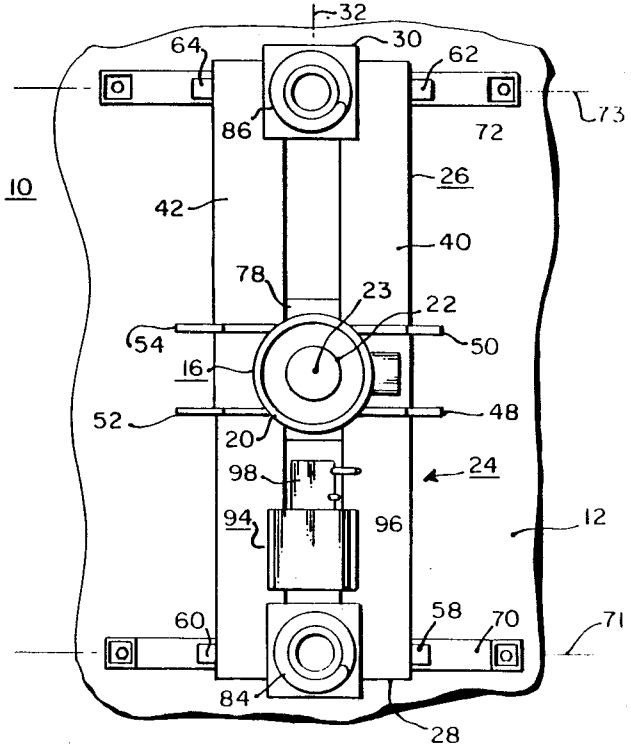
FIG. 3 is a plan view of the hydraulic jack assembly shown in FIGS. 1 and 2.
Figure 2:
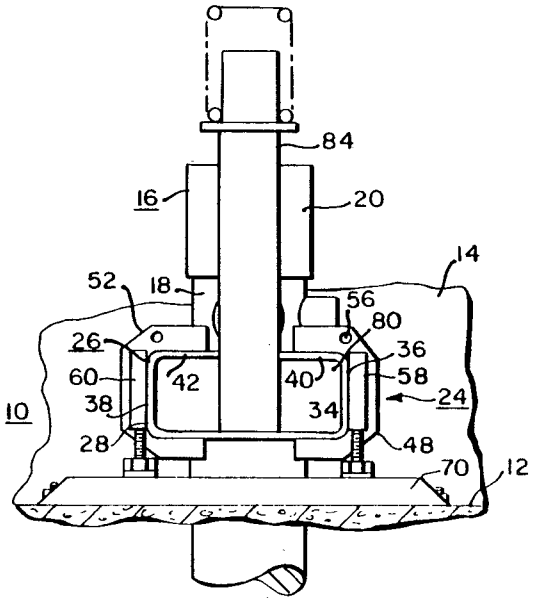
FIG. 2 is an end elevational view of the hydraulic jack assembly shown in FIG. 1.
Figure 4:
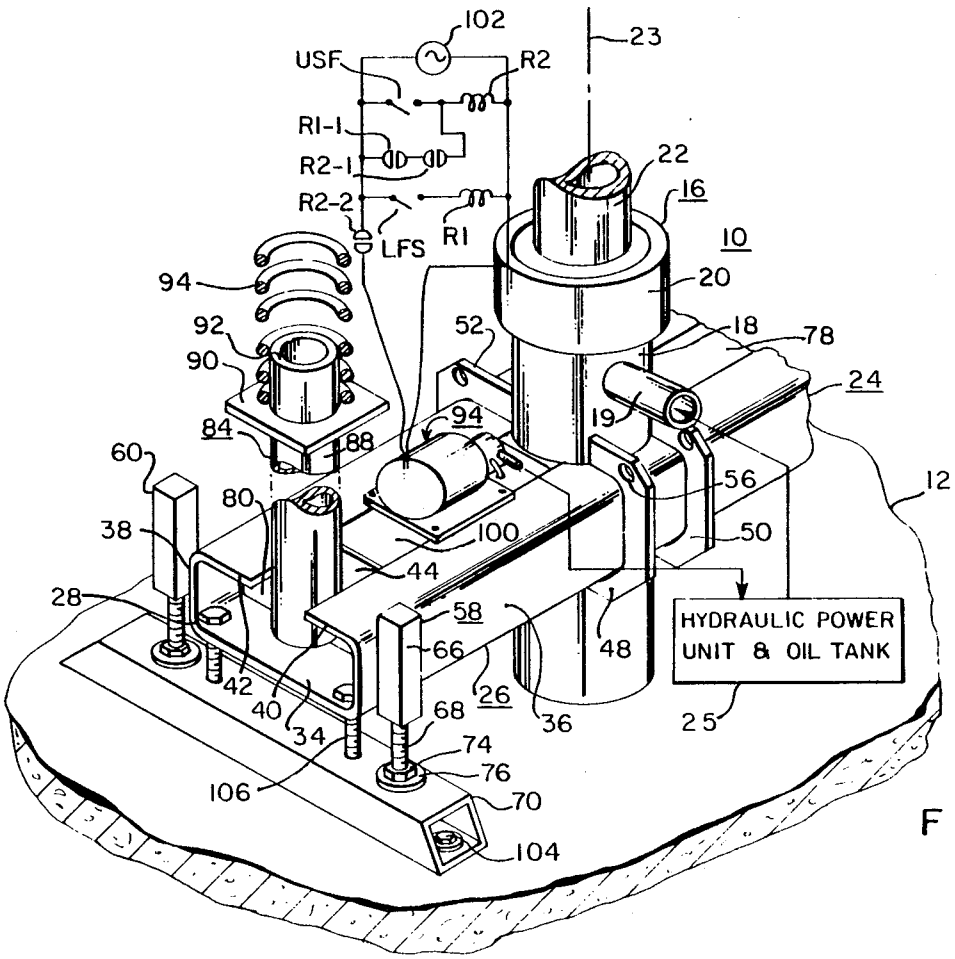
FIG. 4 is a fragmentary perspective view of the hydraulic jack assembly shown in FIGS. 1, 2 and 3.

Referring now to the drawings, FIGS. 1 through 4 set forth a new and improved hydraulic jack assembly 10 constructed according to the teachings of the invention which may be factory assembled and shipped to a job site for installation in an elevator pit 12 of a building 14. FIGS. 1, 2 and 3 are side, end and plan views of jack assembly 10, and FIG. 4 is a fragmentary perspective view. Jack assembly 10 includes a hydraulic jack 16 having a cylinder 18 having a hydraulic fluid connection 19, a cylinder head 20 and a plunger 22 all disposed on a common longitudinal axis 23. Cylinder 18 is in fluid flow communication with a hydraulic power unit and oil tank 25 shown in FIG. 4, which may be conventional. An elevator cab (not shown) is supported on the end of the plunger 22 in a conventional manner.

Jack assembly 10 further includes a mounting footer 24 pre-assembled with the hydraulic jack 16. Mounting footer 24 includes an elongated metallic box beam 26 having first and second ends 28 and 30, respectively, and a longitudinal axis 32 which extends between its ends. Box beam 26 has a bottom 34, first and second spaced upstanding webs 36 and 38, respectively, and first and second horizontally oriented flanges 40 and 42, respectively. Flanges 40 and 42 turn inwardly from the webs 36 and 38, respectively, and define an opening or space 44 between their ends. Box beam 26 is the mechanical equivalent of two spaced channels which have their lower flanges joined to form bottom 34, thus providing the requisite mechanical strength for supporting the hydraulic jack 16. A central opening 46 is formed in the bottom 34 of the box beam 26, and the cylinder 18 is disposed through the opening and welded to the bottom 34 with a fluid tight joint. The flanges 40 and 42 are contoured to snugly encompass cylinder 18, and the contoured portions of the flanges are welded to the cylinder 18.

The webs 36 and 38 of box beam 26 are strengthened by a plurality of web stiffeners symmetrically disposed about longitudinal axis 23 of jack 16, with four web stiffeners 48, 50, 52 and 54 being shown for purposes of example. Each web stiffener 48, 50, 52 and 54 has a substantially C-shaped configuration, and is welded to the cylinder above and below the box beam 26, as well as to a flange, a web, and the bottom of the box beam 26. Since the web stiffeners 48, 50, 52 and 54 are symmetrical about the longitudinal axis 23, they may also function as on-center lifting eyes, and thus may have openings 56 formed therein for that purpose.

Box beam 26 is supported in pit 12 via four vertically oriented metallic bars 58, 60, 62 and 64, two at each end of the box beam 26. Since bars 58, 60, 62 and 64 are of like construction, only bar 58 will be described. Bar 58 has a first portion 66 which preferably has a square or rectangular cross sectional configuration, but a round configuration could be used, which starts at the upper end of the vertical orientation and extends for a dimension about equal to the width of a web 36 or 38. The remaining or second potion 68 of bar 58 is threaded. The squarae first portion of bar 58 is welded across web 36 to attach the bar to the box beam 26, and to provide additional web stiffening. The threaded lower end 68 is utilized as a jacking bolt in a leveling function to level the jack assembly 10 in the pit 12.

In order to prevent skidding or other undesirable movement of the jack assembly 10 when the assembly 10 is being leveled, cross channels or hollow bars 70 and 72, having channel, square or rectangular cross sectional configurations, are utilized at ends 28 and 30 of the box beam 26. The longitudinal axes 71 and 73 of bars 70 and 72, respectively, are oriented perpendicular to the longitudinal axis 32 of box beam 26. For example, as illustrated most clearly in FIG. 4 relative to jacking bolt 58, a nut 74 is threadably engaged with threaded portion 68, a washer 76 is slipped over threaded portion against nut 74, and the remaining portion of the threaded end is inserted into an opening in bar 70. Thus, the interface between moving and stationary surfaces when a leveling assembly is being actuated is moved up from the floor of the pit 12 to the top of the bar 70. Bar 70 cannot turn because if is firmly held near its opposite end by the leveling assembly on the other side of the box beam 26.

The invention takes advantage of the box beam 26 to create an overflow oil reservoir 78 which surrounds the hydraulic cylinder 18 and collects any leakage oil from the cylinder head 20. The overflow oil reservoir 78 is formed by welding first and second upstanding plate members 80 and 82 inside the box beam 26, to provide fluid tight joints. Each plate member, such as plate member 80, is welded to the bottom 34, the upstanding webs 36 and 38, and to the flanges 40 and 42, of box beam 26. Instead of disposing the plate members 80 and 82 at the extreme ends 28 and 30, respectively, of box beam 26, in a preferred embodiment of the invention plate members 80 and 82 are spaced inwardly from ends 28 and 30 by a predetermined dimension which is at least sufficient to accommodate buffers 84 and 86.

Buffers 84 and 86 are of like construction, and thus only buffer 84 will be described in detail. Buffer 84 includes an upstanding metallic member 88, which may be formed from scrap sections of jack 16, if desired. Member 88 may also be formed into a square configuration, or tubing may be used, such as tubing having a square or triangular cross sectional configuration. Member 88 is welded to the bottom 34 of the box beam 26, and to the external side of the upstanding plate member 80. A spring support seat 90 is provided near the upper end of member 88, such as by welding a ring or plate a predetermined dimension below the upper end 92 of member 88. A buffer spring 94, which may be railroad car type or custom springs made from alloy steel or regular carbon spring steel, is supported by spring seat 90 and by the end of member 88 which extends above the spring seat 90.

The hydraulic fluid or oil collected in the overflow oil reservoir 78 may be returned to the oil tank and hydraulic power unit 25 by a low cost motor/pump unit 94 which includes a motor 96, and a pump 98. Unit 94 may be mounted on a plate 100, which may be formed of metal or plastic, as desired, and plate 100 may be partially supported by upstanding plate member 80 and secured to flanges 40 and 42. Any suitable control arrangement may be used to operate unit 94. For example, motor 96 may be connected to a source 102 of electric potential through a normally open contact R2-2 of a relay R2. Upper and lower float switches UFS and LFS, respectively, disposed in oil reservoir 78, control relays R1 and R2, respectively. When the lower float switch LFS is actuated by the oil level in reservoir 78, it picks up relay R1 and its contact R1-1 closes to enable a seal-in circuit for relay R2. When the upper float switch UFS is actuated by the oil level in reservoir 78 relay R2 picks up. Contact R2-1 of relay R2 closes to seal-in relay R2, notwithstanding the subsequent opening of the upper float switch UFS, and contact R2-2 closes to energize motor 96 and pump 98. The oil in reservoir 78 is then pumped back to the oil tank and hydraulic power unit 25 until the oil level in reservoir 78 reaches the level of the lower float switch. When the lower float switch LFS opens, it breaks the seal-in circuit of relay R2 and contact R2-2 opens to de-energize motor 96.

When required by elevator codes, such as in earthquake prone areas, the jack assembly 10 may be fixed to the floor of pit 12 before grouting of the assembly 10. For example, cross bars 70 and 72 may be fixed to the floor of the pit 12 with bolts 104, and, in addition to the jacking bolts 58, box beam 26 may be fixed to the cross bars 70 and 72 via bolts 106 which extend through the bottom 34 of the box beam 26.

I claim as my invention:

1. A hydraulic jack assembly for a hydraulic elevator, comprising:

a jack having a cylinder, cylinder head, and plunger on a common longitudinal axis, an elongated box beam having first and second ends, a bottom, first and second upstanding web portions, and first and second laterally extending flange members which extend inwardly from said first and second web portions, respectively, said cylinder extending upwardly through the bottom of said elongated box beam with a fluid tight joint, said cylinder being fixed to said bottom and to said first and second flange members of the box beam, first and second upstanding end plate members fixed inside said boxed beam with fluid tight joints, said box beam and first and second end plate members defining an overflow oil reservoir which surrounds said jack below said cylinder head for collecting oil which may leak from said cylinder head, first and second upstanding buffers fixed to said box beam, a hydraulic power unit having an oil tank, and pump means mounted on said box beam for pumping oil from said overflow oil reservoir to the oil tank of said hydraulic power unit.

2. A hydraulic jack assembly for a hydraulic elevator, comprising:

a jack having a cylinder, cylinder head, and plunger on a common longitudinal axis, an elongated box beam having first and second ends, a bottom, first and second upstanding web portions, and first and second laterally extending flange members which extend inwardly from said first and second web portions, respectively, said cylinder extending upwardly through the bottom of said elongated box beam with a fluid tight joint, said cylinder being fixed to said bottom and to said first and second flange members of the box beam, web stiffeners fixed to the box beam and to the cylinder, with said web stiffeners being symmetrically disposed about the longitudinal axis of the cylinder to enable said web stiffeners to also function as on-center lifting eyes, first and second upstanding end plate members fixed inside said boxed beam with fluid tight joints, said box beam and first and second end plate members defining an overflow oil reservoir which surrounds said jack below said cylinder head for collecting oil which may leak from said cylinder head, and first and second upstanding buffers fixed to said box beam.

3. A hydraulic jack assembly for a hydraulic elevator, comprising:

a jack having a cylinder, cylinder head, and plunger on a common longitudinal axis, an elongated box beam having first and second ends, a bottom, first and second upstanding web portions, and first and second laterally extending flange members which extend inwardly from said first and second web portions, respectively, said cylinder extending upwardly through the bottom of said elongated box beam with a fluid tight joint, said cylinder being fixed to said bottom and to said first and second flange members of the box beam, first and second upstanding end plate members fixed inside said boxed beam with fluid tight joints, said box beam and first and second end plate members defining an overflow oil reservoir which surrounds said jack below said cylinder head for collecting oil which may leak from said cylinder head, first and second upstanding buffers fixed to said box beam, and means for supporting the weight of the hydraulic jack assembly, with said weight support means being fixed to the first and second webs of the box beam adjacent to each of the first and second ends of the box beam, to additionally function as web stiffeners.

4. The hydraulic jack assembly of claim 3 including leveling means fixed to said weight support means.

5. The hydraulic jack assembly of claim 4 wherein the means for supporting the weight of the hydraulic jack assembly includes means for preventing the jack assembly from skidding when the leveling means is actuated.

6. A hydraulic jack assembly for a hydraulic elevator, comprising:

a jack having a cylinder, cylinder head, and plunger on a common longitudinal axis, an elongated box beam having first and second ends, a bottom, first and second upstanding web portions, and first and second laterally extending flagne members which extend inwardly from said first and second web portions, respectively, said cylinder extending upwardly through the bottom of said elongated box beam with a fluid tight joint, said cylinder being fixed to said bottom and to said first and second flange members of the box beam, first and second upstanding end plate members fixed inside said boxed beam with fluid tight joints, said box beam and first and second end plate members defining an overflow oil reservoir which surrounds said jack below said cylinder head for collecting oil which may leak from said cylinder head, and first and second upstanding buffers fixed to said box beam, said first and second upstanding end plate members being fixed inside the box beam inwardly from the first and second ends of the box beam to provide space for the first and second buffers between the first and second end plate members and the first and second ends of the box beam, said first and second upstanding buffers being respectively fixed to the first and second upstanding end plate members, and to the bottom of the box beam.

7. A hydraulic jack assembly for a hydraulic elevator, comprising:

a jack having a cylinder, cylinder head, and plunger on a common longitudinal axis, an elongated box beam having first and second ends, a bottom, first and second upstanding web portions, first and second laterally extending flange members which extend inwardly from said first and second web portions, respectively, and a longitudinal axis which extends between said first and second ends, first and second cross bar members at the first and second ends, respectively, of said box beam, having axes disposed perpendicular to the longitudinal axis of the box beam, said first and second cross bar members being disposed below the box beam, leveling means disposed between said box beam and said first and second cross bar member which also function to support the weight of the box beam, said cylinder extending upwardly through the bottom of said elongated box beam with a fluid tight joint, said cylinder being fixed to said bottom and to said first and second flange members of the box beam, first and second upstanding end plate members fixed inside said boxed beam with fluid tight joints, said box beam and first and second end plate members defining an overflow oil reservoir which surrounds said jack below said cylinder head for collecting oil which may leak from said cylinder head, and first and second upstanding buffers fixed to said box beam.

8. The hydraulic jack assembly of claim 7 including first earthquake fastener means disposed to fix the box beam to the first and second cross bar members, and second earthquake fastener means for fixing the first and second cross bar members to an associated elevator pit.

* * * * *